US007303232B1

(12) United States Patent
Chen

(10) Patent No.: US 7,303,232 B1
(45) Date of Patent: Dec. 4, 2007

(54) BACKREST ADJUSTING DEVICE FOR OFFICE CHAIRS

(76) Inventor: Yung-Hua Chen, 1F, No.2, Lane 157, Wan-an Street, Sinjhuang City, Taipei County 242 (TW)

( * ) Notice: Subject to any disclaimer, the term of this patent is extended or adjusted under 35 U.S.C. 154(b) by 0 days.

(21) Appl. No.: 11/634,850

(22) Filed: Dec. 7, 2006

(51) Int. Cl.
*A47C 7/46* (2006.01)
*A47C 7/38* (2006.01)

(52) U.S. Cl. ..... 297/284.8; 297/284.7; 297/408; 297/410; 297/405

(58) Field of Classification Search ..... 297/284.4, 297/284.7, 284.8, 354.11, 405, 408, 409, 297/410
See application file for complete search history.

(56) References Cited

U.S. PATENT DOCUMENTS 2,666,476 A * 1/1954 Lycan ..... 297/404
4,730,871 A * 3/1988 Sheldon ..... 297/284.7
4,856,848 A * 8/1989 O'Sullivan et al. ..... 297/391
4,893,872 A * 1/1990 Sugai ..... 297/284.8
6,092,871 A * 7/2000 Beaulieu ..... 297/284.4
6,419,318 B1 * 7/2002 Albright ..... 297/284.7
6,616,236 B1 * 9/2003 Su ..... 297/410
6,843,530 B1 * 1/2005 Wu ..... 297/284.4
6,848,744 B1 * 2/2005 Raftery et al. ..... 297/284.1
7,063,384 B2 * 6/2006 Liu ..... 297/284.4
2005/0062323 A1 * 3/2005 Dicks ..... 297/284.4

* cited by examiner

*Primary Examiner*—Peter R. Brown
(74) *Attorney, Agent, or Firm*—Rosenberg, Klein & Lee

(57) ABSTRACT

A backrest adjusting device for office chairs comprising: a seat portion having a seat cushion and a stand for supporting the seat cushion; a back having a frame, a back cushion fixed on the surface of the frame, a connecting member for connecting the bottom of the back to a rear side of the seat portion, a hollow containing space formed at the middle section of the back, an n-shaped member being disposed in the containing space and extended backward; and a first attaching device installed on the n-shaped member of the containing space, thereby achieving the adjustment of the three-dimensional space of position, longitudinal buffer and angular rotation. Moreover, the back further includes a support member disposed at the top of the back, and a second attaching device installed on the support member and having a structure identical to the first attaching device. Meanwhile, the first attaching device has an attaching body made in compliance with the shape of a human waist to form a backrest bump. Furthermore, the second attaching device has an attaching body made in compliance with the shape of a human head to form a headrest. In this way, the three-dimensional space such as position, height, longitudinal buffer and angular rotation of a backrest or a headrest is adjustable.

5 Claims, 9 Drawing Sheets

BACKREST ADJUSTING DEVICE FOR OFFICE CHAIRS

BACKGROUND OF THE INVENTION

1. Field of the Invention

The present invention relates to a backrest adjusting device for office chairs, and more particularly to a novel spatial design for a backrest and a headrest with the features of adjustable height, longitudinal buffer and angular rotation.

2. Description of the Related Art

Referring to FIG. 1 for a conventional office chair, the chair includes a stand 51 having a plurality of rollers, a seat cushion 52 fixed by an erected support rod, a backrest 53 installed vertically at the rear end of the seat cushion 52, and an arc streamlined headrest 55 pivotally connected to the backrest 53 by a plurality of insert rods 54. The height of the headrest 55 can be adjusted by fixing the positions of the insert rods 54 and the backrest 53. However, a problem of such structure resides on that the best leaning angle of a person's neck varies with each person's type of build, need and feel, when the person is sitting on a chair. Obviously, the design of the conventional fixed headrest violates these principles and definitely does not comply with practical applications.

Similarly, the structure of a backrest bump 56 of a conventional chair is connected by a transmission module (not shown in the figure) in the backrest 53 for indirectly driving a stand board in the backrest 53 for its extension and displacement. Since the driving position is situated at a lateral side of the backrest 53, the actual installation and operation of the chair greatly affect the overall stylish look of the chair, and the detached parts occupy much storage space when they are not in use. Further, the extensible and displaceable backrest bump 56 installed in the backrest cannot achieve the effect of supporting a user's waist or providing the elasticity for the backrest bump 56 due to the limitation by a too small driving extension and displacement. Further, the extensible and displaceable backrest bump 56 installed in the backrest 53 requires an extra transmission module to drive a stand board in the backrest 53 for the extension and displacement, and such arrangement incurs additional component and installation costs.

Therefore, it is a subject for the related industry and an expectation of consumers to overcome the existing shortcomings of the headrest and backrest of a conventional chair by providing an adjustable chair structure.

SUMMARY OF THE INVENTION

It is a primary object of the invention to provide a backrest adjusting device for office chairs, such that the three-dimensional space including position, height, longitudinal buffer and angular rotation of a backrest or a headrest can be adjusted according to a user's type of build, need and feel to improve the effect of achieving the best attaching angle.

In order to achieve the above-mentioned object, the backrest adjusting device for office chairs includes:

a) a seat portion having a seat cushion and a stand for supporting the seat cushion;

b) a back having a frame, a back cushion fixed on the surface of the frame, a connecting member for connecting the bottom of the back to a rear side of the seat portion, a hollow containing space formed at the middle section of the back, and an n-shaped member being disposed in the containing space and extended backward; and c) a first attaching device installed on the n-shaped member of the containing space, thereby achieving the adjustment of the three-dimensional space of position, longitudinal buffer and angular rotation, wherein the first attaching device includes:

i) at least two parallel pipe bodies fixed on an internal side of the n-shaped member with an opening facing upward;

ii) at least two springs sheathed into each pipe body;

iii) at least two pivots, each including a first pivot and a second pivot pivotally connected with each other, wherein the first pivot has at least one portion sheathed into the pipe body and fixed by a bolt installed from a rear side of the pipe body for fixing the spring, and the second pivot is protruded and exposed from the front of the pipe body and includes a longitudinal penetrating hole, and a transversal positioning member is perpendicular to the longitudinal penetrating hole, and an end of an internal side of the transversal positioning member includes a small dome slightly protruded from a hole wall of the longitudinal penetrating hole;

iv) at least two parallel rod bodies separately passing through a longitudinal penetrating hole of each second pivot and having a plurality of aligned slots corresponding to a side of the transversal positioning member, such that one of the slots is selected for embedding and positioning a small dome; and v) an attaching body being an ergonomic design with a curved shape and fixed onto upper and lower ends of two parallel rod bodies, and its surface having an external wrapped surface.

DETAILED DESCRIPTION OF THE PREFERRED EMBODIMENT

Figure 1:
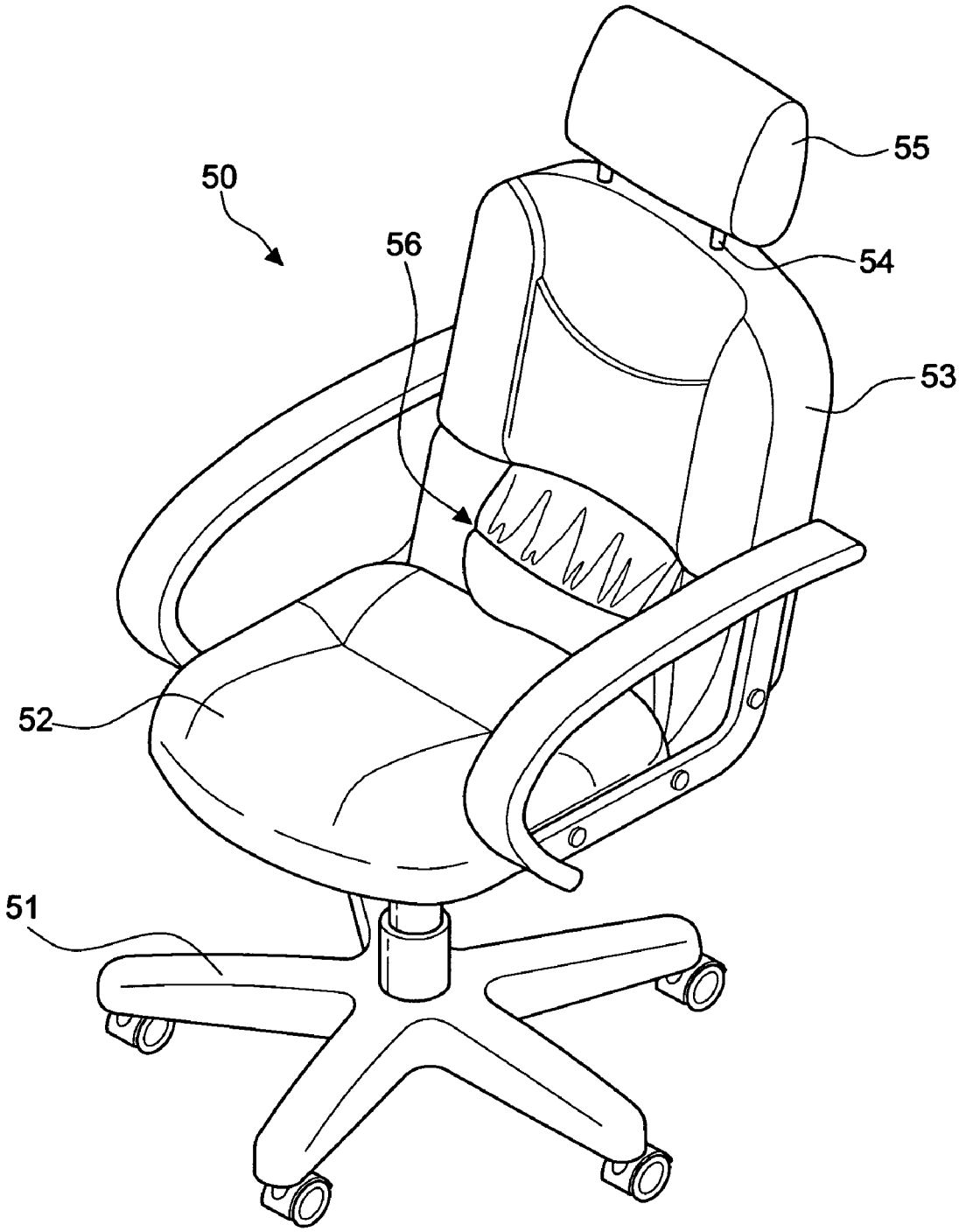
FIG.1 (PRIOR ART)
FIG. 1 is a perspective view of a conventional office chair.
Figure 2:
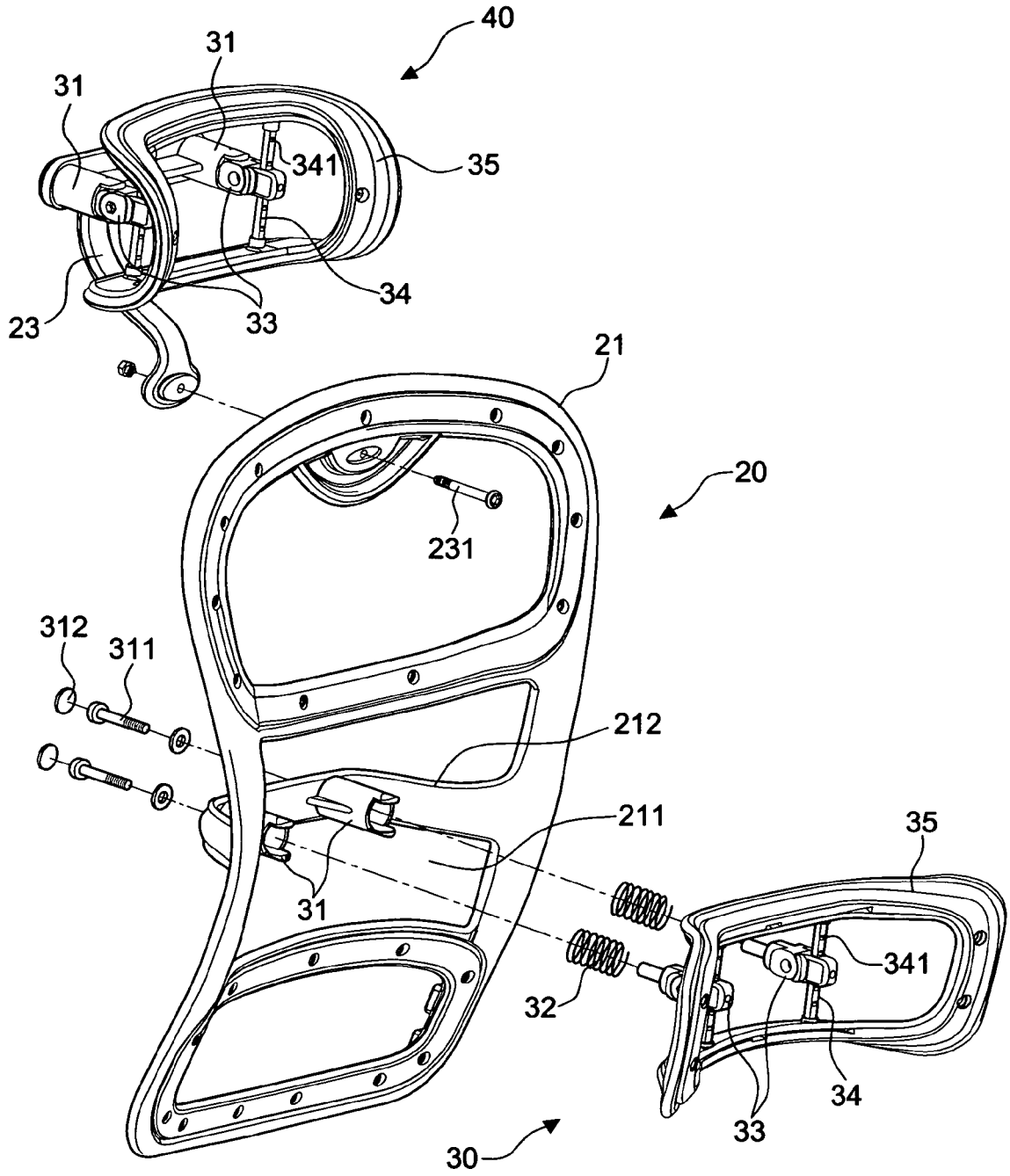
FIG. 2 is an exploded view of a back structure of an office chair of the present invention.
Figure 3:
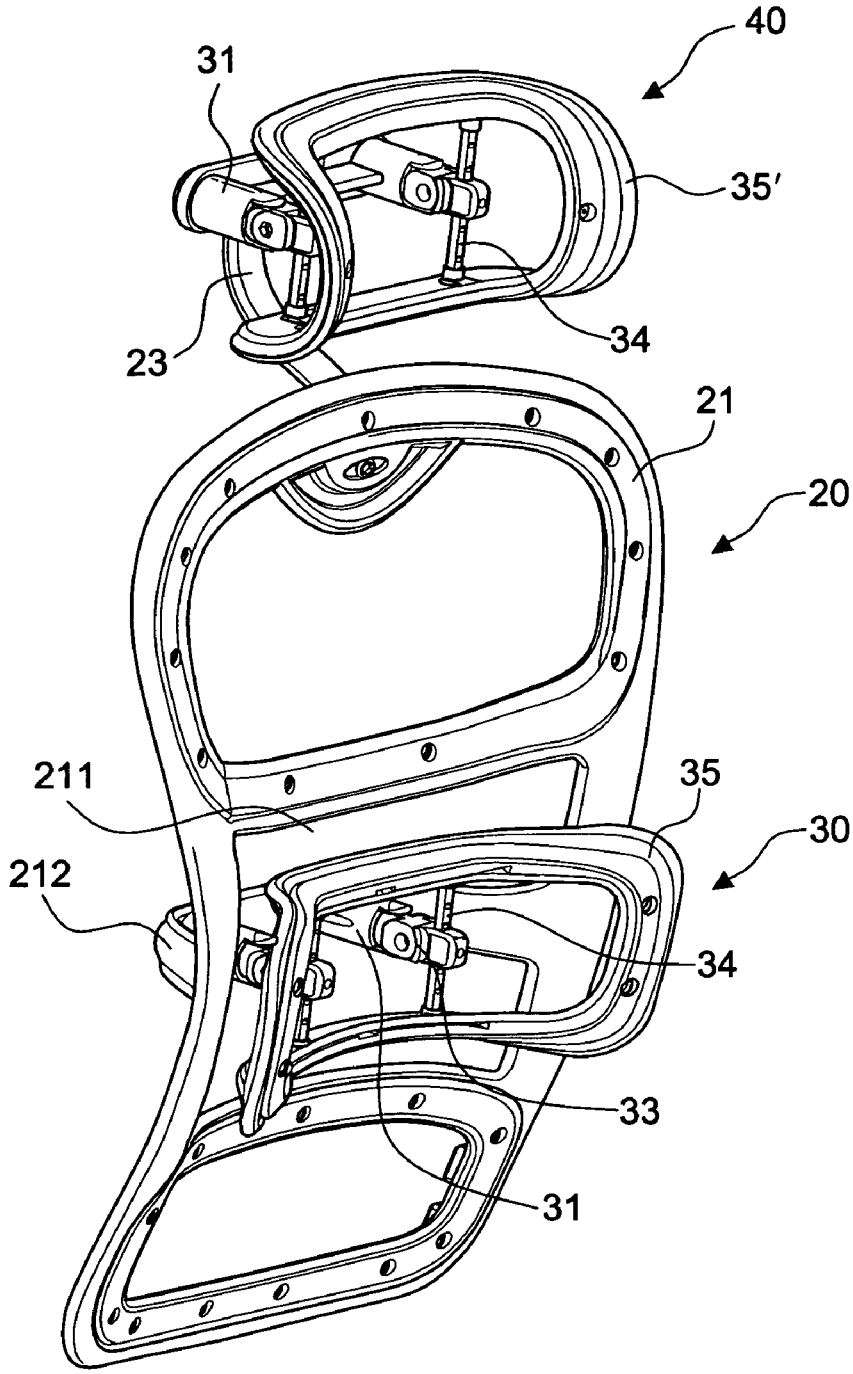
FIG. 3 is a perspective view of an assembled back structure of an office of the present invention.
Figure 4:
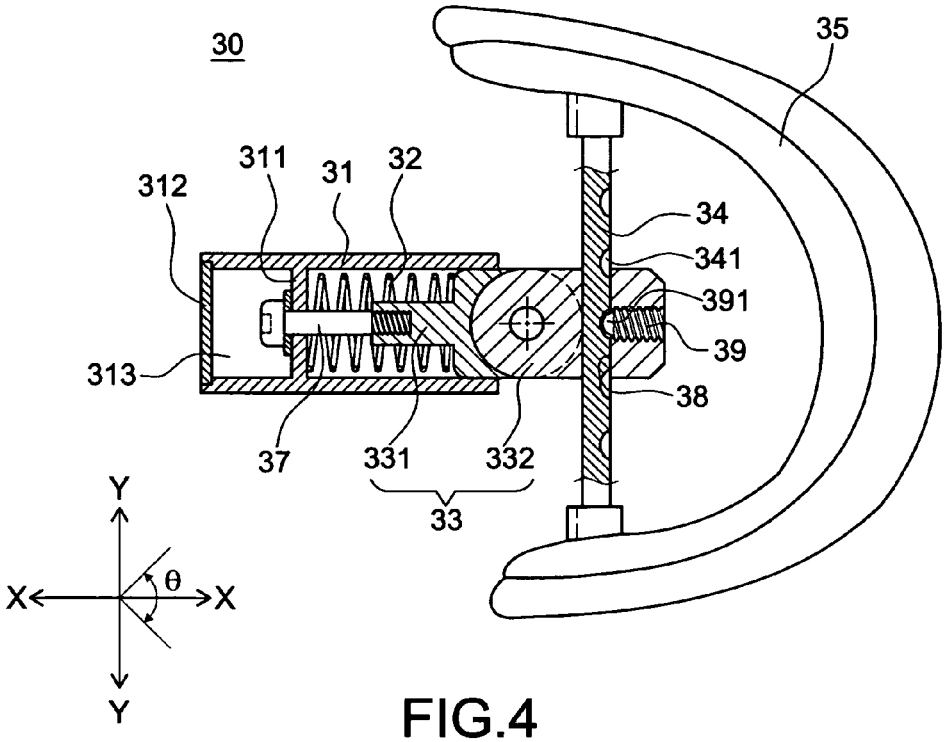
FIG. 4 is a cross-sectional view of an attaching device of the present invention.
Figure 8:
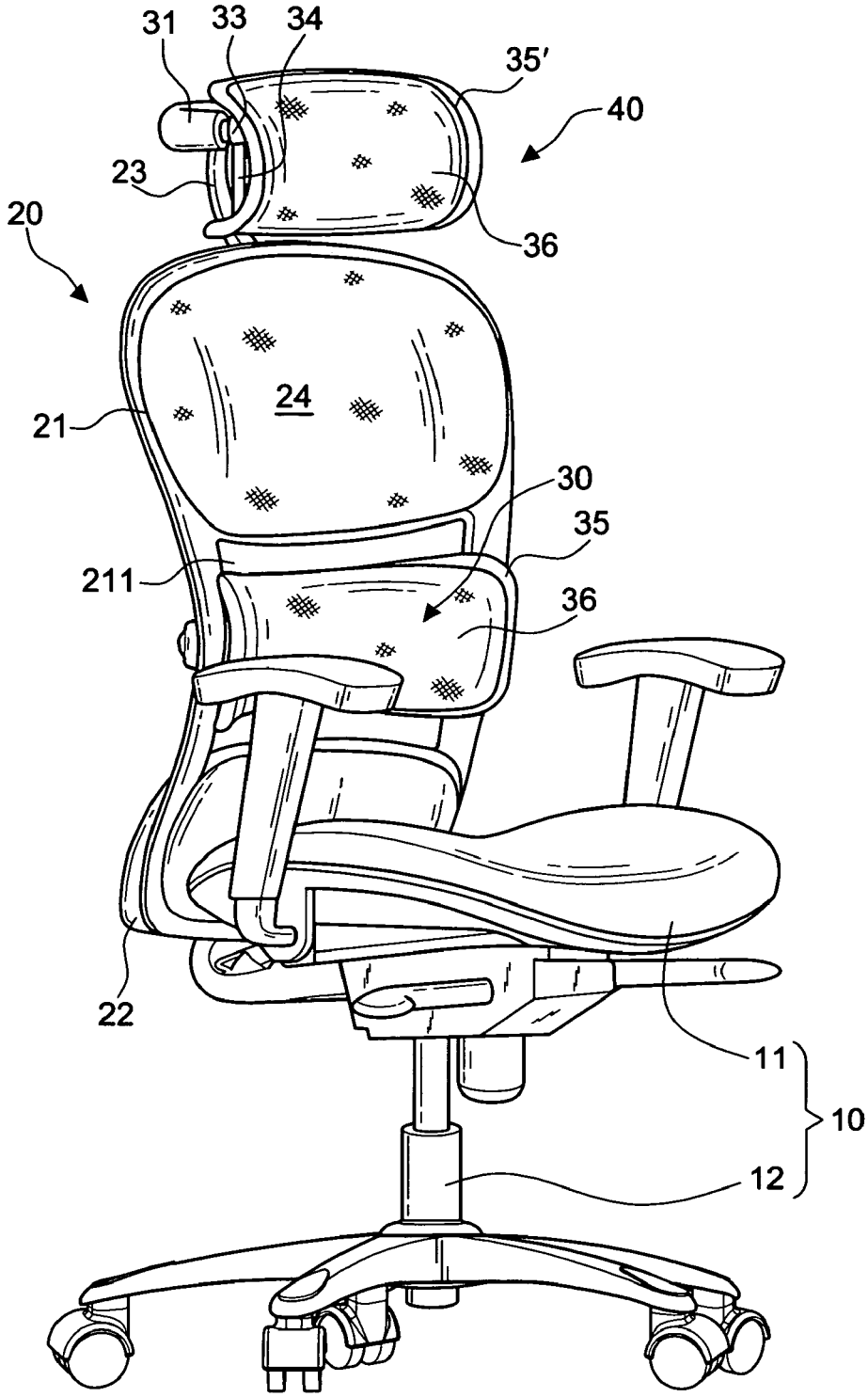
FIG. 8 is a perspective view of a first preferred embodiment of the present invention.

Referring to FIGS. 2 and 3 for an exploded view and a perspective view of a backrest of the present invention, a back 20 includes a frame 21, a back cushion 24 fixed onto a surface of the frame 21 as shown in FIG. 8, a connecting member 22 installed at a rear side of the seat portion 10 for connecting the bottom of the back 20, a hollow containing space 21 disposed at the middle section of the back 20, an n-shaped member 211 disposed in the containing space and extended backward, and a first attaching device 30 installed on an n-shaped member 211 of the containing space for adjusting the height, longitudinal buffer and angular rotation of the back 20. Referring to FIG. 4 for a cross-sectional view of the foregoing first attaching device 30, the structure as shown in FIGS. 2 to 4 comprises:

at least two parallel pipe bodies 31, fixed on an internal side of the n-shaped member 211 with an opening facing upward;

at least two springs 32, sheathed into each pipe body 31;

at least two pivots 33, each including a first pivot 331 and a second pivot 332 pivotally connected with each other, wherein the first pivot 331 has at least one portion sheathed into the pipe body 31 and fixed by a bolt 37 installed from a rear side of the pipe body 31 for fixing the spring 32, and the second pivot 332 is protruded and exposed from the front of the pipe body 31 and includes a longitudinal penetrating hole 38, and a transversal positioning member 39 perpendicular to the longitudinal penetrating hole 38, and an end of an internal side of the transversal positioning member 39 includes a small dome 391 slightly protruded from a hole wall of the longitudinal penetrating hole 38;

at least two parallel rod bodies 34, separately passed through a longitudinal penetrating hole 38 of each second pivot 332, and corresponding to a side of the transversal positioning member 39 and having a plurality of aligned slots 341, such that one of the slots 341 is selected for embedding and positioning a small dome 391; and an attaching body 35, being an ergonomic design with a curved shape and fixed onto upper and lower ends of two parallel rod bodies 34, and its surface has an external wrapped surface 36.

Figure 5:
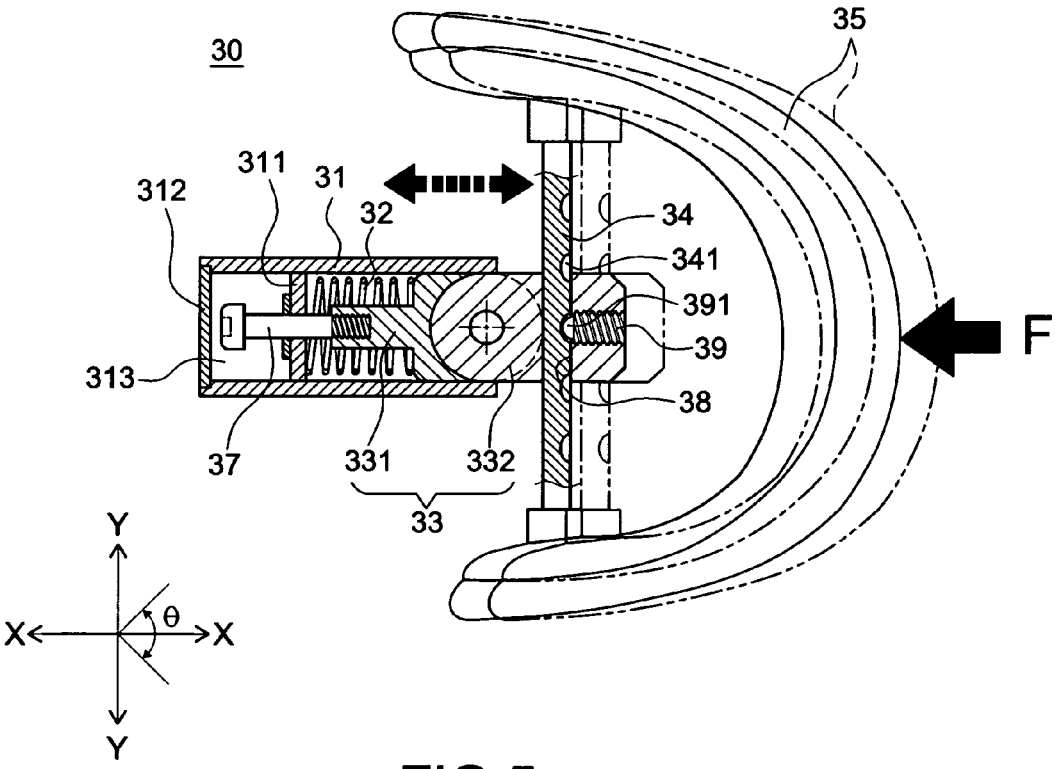
FIG. 5 is a schematic view of adjusting the longitudinal depth of an attaching device of the present invention.

Based on the foregoing assembly, the present invention features a function of adjusting the three-dimensional space. In FIG. 5, a spring 32 in the pipe body 31 provides the function of buffering and resuming the attaching body 35 into its original position, if an action force F of a user's waist is exerted onto the attaching body 35 of the first attaching device 30 and a longitudinal depth of the pivot 33 is adjusted and displaced along the X-X direction. In this embodiment, the pipe body 31 contains a partition 311 for passing and fixing a bolt 37 to define a space 313 provided for the bolt 37 to be extended, and the rear end of the pipe body 31 includes a cover plate 312.

Figure 6:
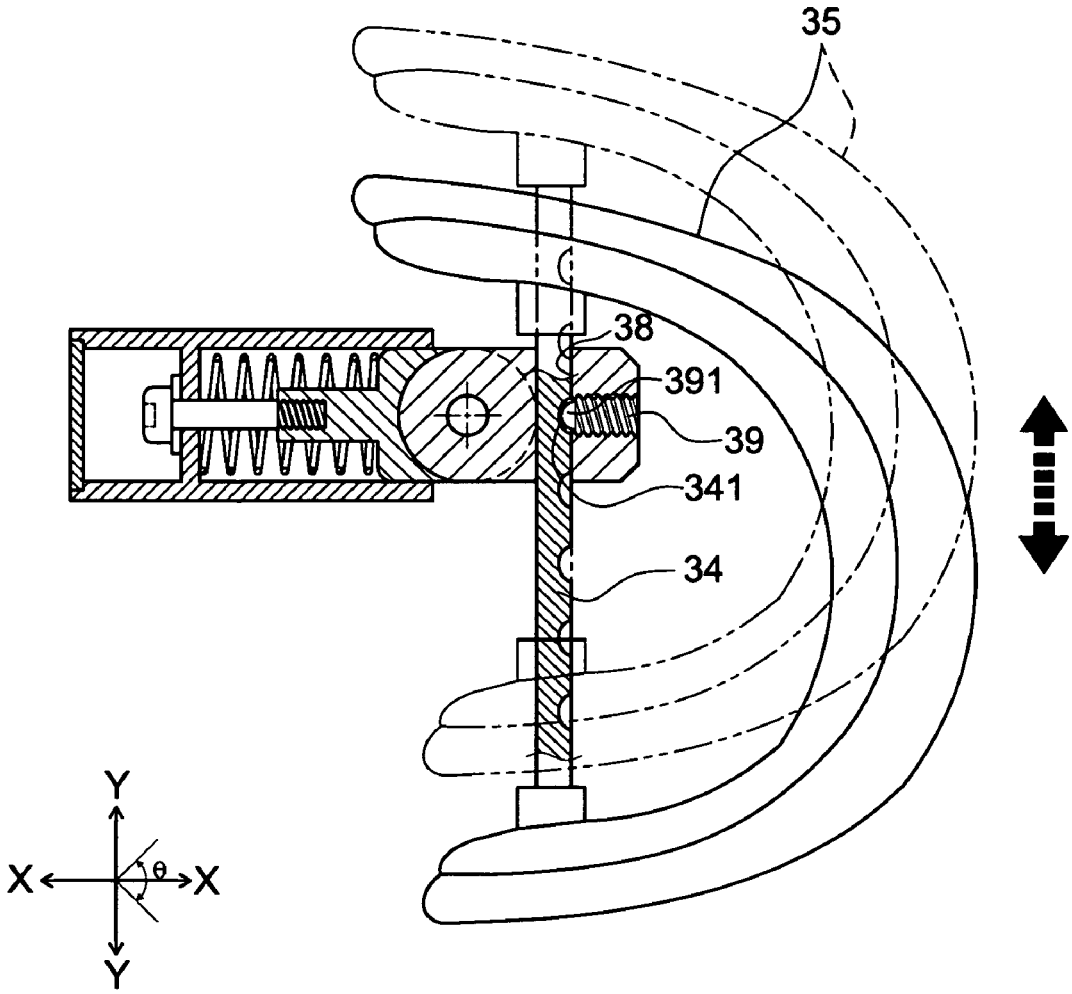
FIG. 6 is a schematic view of adjusting the height of an attaching device of the present invention.

FIG. 6 shows a schematic view of adjusting the height of the first attaching device 30 along the Y-Y direction, and the rod body 34 is disposed vertically up and down in the longitudinal penetrating hole 38, such that the preinstalled slot 341 can reach the position of the small dome 391 disposed on an internal side of the transversal positioning member 39. In this embodiment, the small dome 391 has a contractible flexibility that is a common property of a hardware component, and thus will not be described in detail here. Therefore, the height of the attaching body 35 can be adjusted appropriately along the Y-Y direction.

Figure 7:
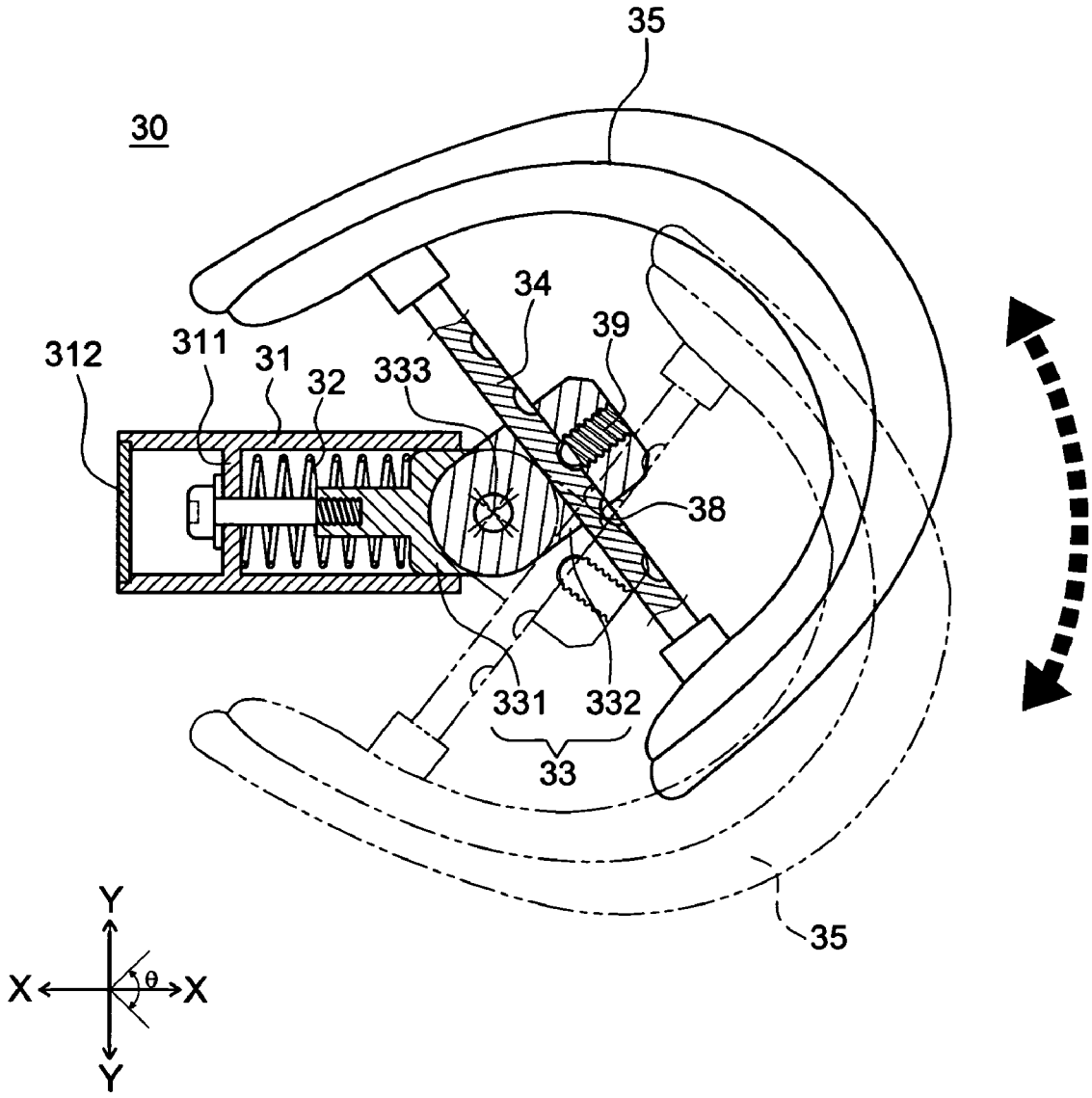
FIG. 7 is a schematic view of adjusting the angle of an attaching device of the present invention.

FIG. 7 shows a schematic view of an angular rotation of the first attaching device 30, the second pivot 332 of the pivot 33 can be rotated to an angle θ by using a pivotal shaft 333 as an axle center to achieve the best attaching angle.

The aforementioned three different spaces can be adjusted simultaneously to cope with a user's requirement to achieve the best attaching angle and position to provide a comfortable seat.

In the present invention as shown in FIGS. 2 and 3, the top of the back 20 is fixed to a support body 23 by a bolt 231 in addition to the first attaching device 30 installed at the back 20, and the support body 23 installs a second attaching device 40 with a structure identical to the first attaching device 30, and its function is also the same as the first attaching device 30, and thus the second attaching device will not be described in detail here. The only difference resides on that the attaching body 35 of the first attaching device 30 is designed according to a human waist to form a backrest, and the attaching body 35' of the second attaching device 40 is designed according to a human head to form a headrest.

Figure 9:
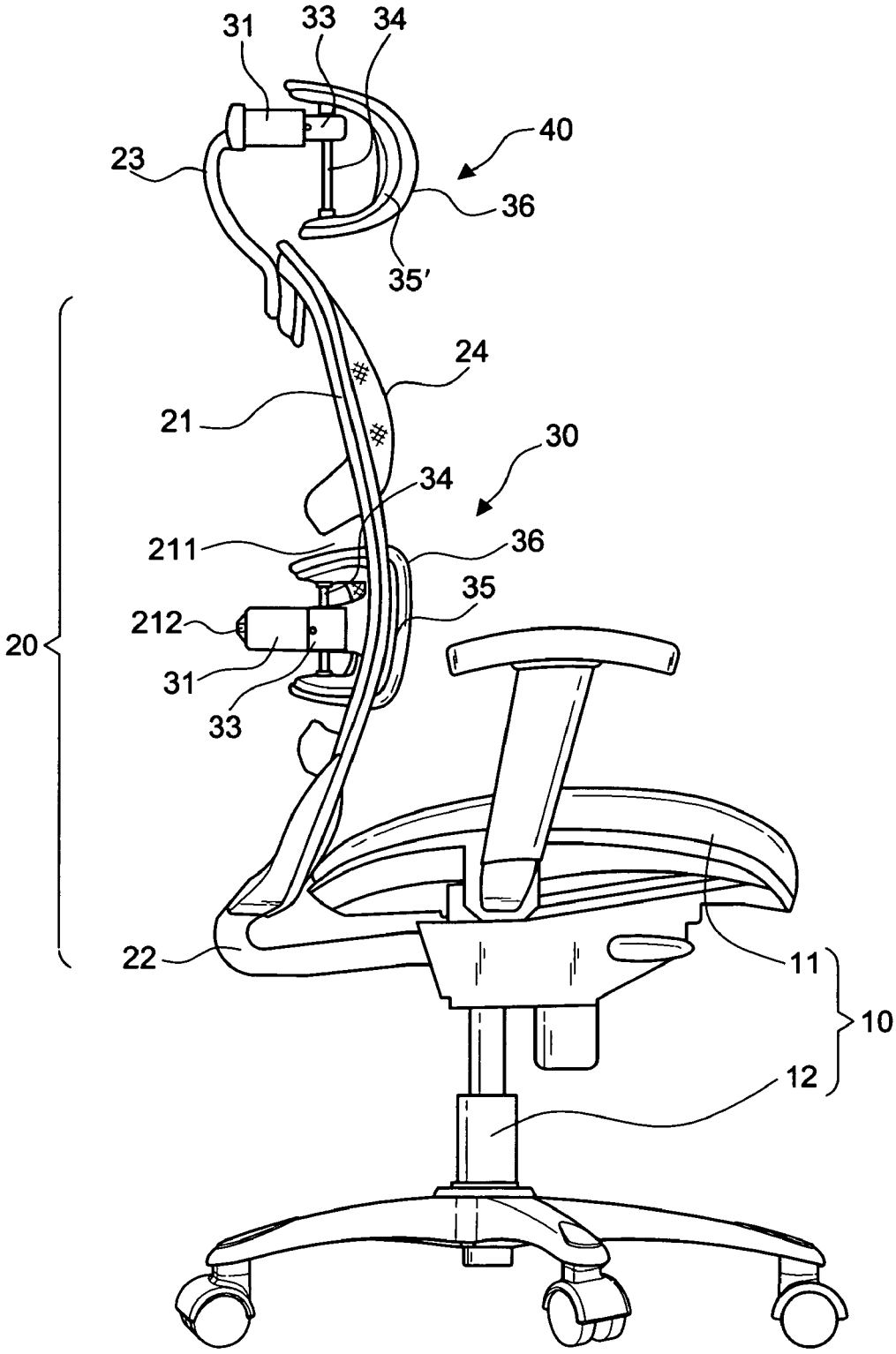
FIG. 9 is a side view of a first preferred embodiment of the present invention.

FIGS. 8 and 9 are a perspective view and a side view of a preferred embodiment of the present invention respectively, the back 20 comprises a first attaching device 30 serving as a backrest, and a second attaching device 40 serving as a headrest, and the back 20 is installed at a rear side of the seat body 10, and the seat body 10 includes a seat cushion 11 and a stand 12 for supporting the seat cushion 10. Further, the external wrapped surface 36 of the attaching body 35, 35' of the first and second attaching devices 30, 40 is made of a material of mesh fabric, woven cloth and leather.

Figure 10:
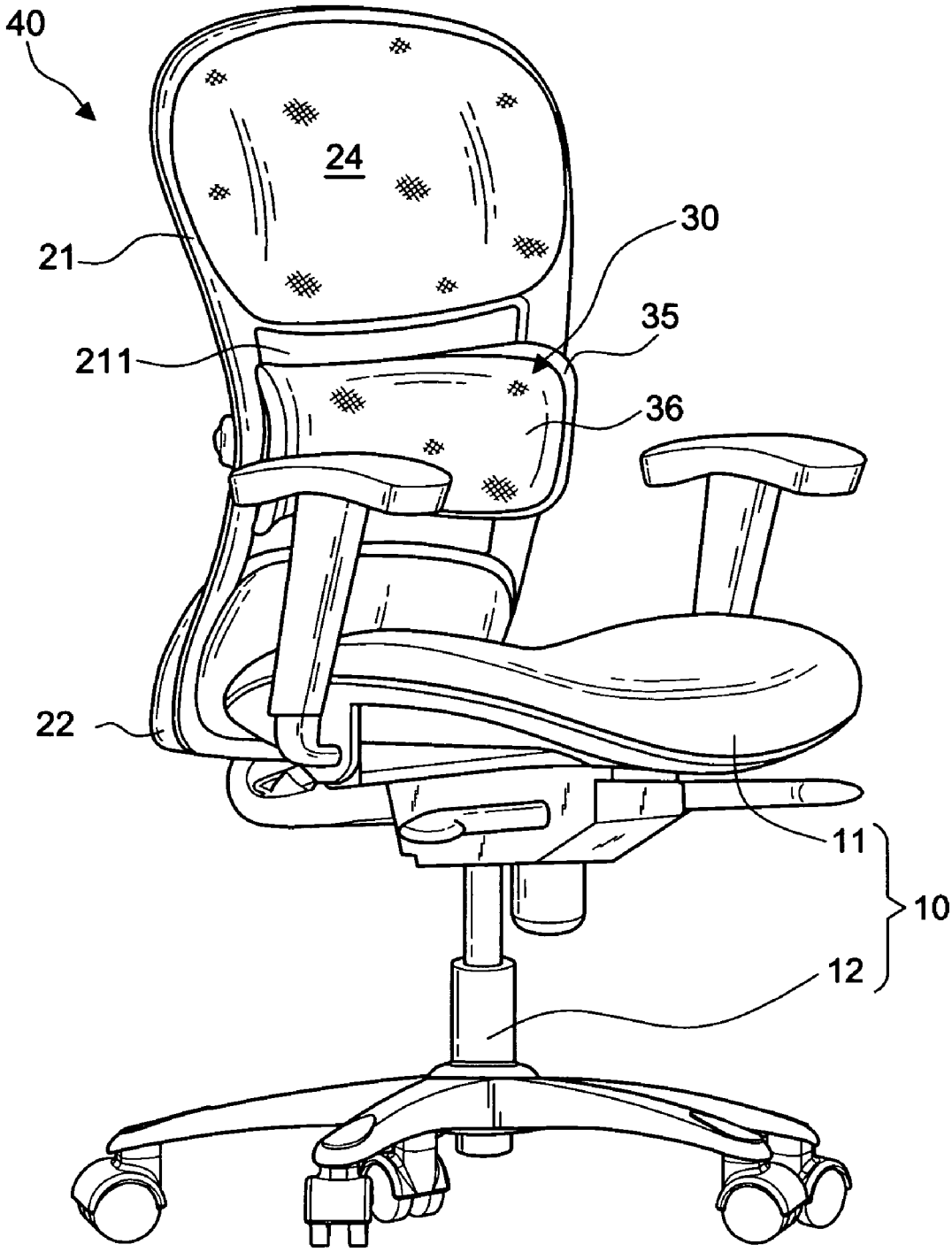
FIG. 10 is a perspective view of a second preferred embodiment of the present invention.

The position, height, longitudinal buffer and angular rotation of the backrest or headrest of the back 20 can be adjusted to provide a comfortable seat and prevent a sore waist or an aching back. FIG. 10 shows an embodiment having a first attaching device 30 only, but it does not have a second attaching device 40. In other words, the adjusting device also can be applied to a chair without a headrest.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A backrest adjusting device for office chairs, comprising:

a) a seat portion having a seat cushion and a stand for supporting the seat cushion;

b) a back having a frame, a back cushion fixed on the surface of the frame, a connecting member for connecting the bottom of the back to a rear side of the seat portion, a hollow containing space formed at the middle section of the back, and an n-shaped member being disposed in the containing space and extended backward; and c) a first attaching device installed on the n-shaped member of the containing space, thereby achieving the adjustment of the three-dimensional space of position, longitudinal buffer and angular rotation, wherein the first attaching device includes:

i) at least two parallel pipe bodies fixed on an internal side of the n-shaped member with an opening facing upward;

ii) at least two springs sheathed into each pipe body;

iii) at least two pivots, each including a first pivot and a second pivot pivotally connected with each other, wherein the first pivot has at least one portion sheathed into the pipe body and fixed by a bolt installed from a rear side of the pipe body for fixing the spring, and the second pivot is protruded and exposed from the front of the pipe body and includes a longitudinal penetrating hole, and a transversal positioning member is perpendicular to the longitudinal penetrating hole, and an end of an internal side of the transversal positioning member includes a small dome slightly protruded from a hole wall of the longitudinal penetrating hole;

iv) at least two parallel rod bodies separately passing through a longitudinal penetrating hole of each second pivot and having a plurality of aligned slots corresponding to a side of the transversal positioning member, such that one of the slots is selected for embedding and positioning a small dome; and v) an attaching body being an ergonomic design with a curved shape and fixed onto upper and lower ends of two parallel rod bodies, and its surface having an external wrapped surface.

2. The backrest adjusting device for office chairs as recited in claim 1, wherein the back further includes a support member disposed at the top of the back, and a second attaching device installed on the support member and having a structure identical to the first attaching device.

3. The backrest adjusting device for office chairs as recited in claim 2, wherein the second attaching device has an attaching body formed in a contour of curvature representative of a human head to form a headrest.

4. The backrest adjusting device for office chairs as recited in claim 1, wherein the first attaching device has an attaching body formed in a contour of curvature representative of a human waist to form a backrest bump.

5. The backrest adjusting device for office chairs as recited in claim 1, wherein the attaching body has an external wrapped surface made of a material selected from the collection of a mesh fabric, a woven cloth and a leather.

* * * * *